United States Patent [19]

Vandenberg et al.

[11] Patent Number: 4,531,309

[45] Date of Patent: Jul. 30, 1985

[54] CROSS-COUNTRY SKI, SKI BOOT, AND BINDING COMBINATION AND BOOT AND BINDING COMPONENTS THEREOF

[76] Inventors: John H. Vandenberg, 20 N. Ridge Way, Sandy, Utah 84092; Michael J. Mendenhall, 1063 W. Westfield Rd., Alpine, Utah 84003

[21] Appl. No.: 416,920

[22] Filed: Sep. 13, 1982

[51] Int. Cl.[3] ..... A43B 5/04; A63C 9/20

[52] U.S. Cl. ..... 36/117; 280/615; 280/623

[58] Field of Search ..... 36/117–121, 36/132; 280/611, 613, 614, 615, 617, 623

[56] References Cited

U.S. PATENT DOCUMENTS

| | | | |
|---|---|---|---|
| 3,003,777 | 10/1961 | Hilding | 280/614 |
| 3,273,263 | 9/1966 | Klima | 36/117 X |
| 3,992,789 | 11/1976 | Dikoff | 36/117 |
| 4,032,172 | 6/1977 | Pyzel et al. | 280/615 |
| 4,082,312 | 4/1978 | Johnson | 280/615 |
| 4,108,467 | 8/1978 | Kreyenbuhl | 280/615 |
| 4,146,247 | 3/1979 | Johansson et al. | 280/615 |
| 4,363,498 | 12/1982 | Biermann et al. | 36/117 X |

FOREIGN PATENT DOCUMENTS

| | | | |
|---|---|---|---|
| 2231058 | 12/1973 | Fed. Rep. of Germany | 280/614 |
| 515242 | 2/1955 | Italy | 280/623 |
| 84635 | 10/1935 | Sweden | 280/615 |

*Primary Examiner*—James Kee Chi

*Attorney, Agent, or Firm*—Mallinckrodt, Mallinckrodt, Russell & Osburn

[57] ABSTRACT

A cross-country ski boot, ski binding, and ski combination includes a boot having a thick sole which is recessed beneath the toe of the boot upper to receive a toe-fitting of the binding which has a transverse forward portion provided with a transverse bore therethrough. A toe plate secured to the ski has upstanding cheek plates at respectively opposite sides thereof, which are provided with mutually registering holes and between which the transverse forward portion of the boot toe-fitting is placed, with its bore in registry with the cheek plate holes. The bore of the transverse forward portion of the boot toe-fitting is located back of the tip of the toe of the boot upper and, with the cheek plate holes, receives a pivot pin which provides a pivot axis transversely of the ski. Resilient means bearing against the front of such transverse forward portion of the boot toe-fitting is preferably provided to keep the ski tip down when in the air during cross-country jumping.

17 Claims, 4 Drawing Figures

10a
10
28
12
12
13
10c
10b
11
2
12
16
15
14b
12
21
16
14
15b
23b
15c
24
26
2
10d
12a
14a
25a
18
14c
23
22
25b
23a
28

12
11
15
16
14
15a
12
12
12
15a
18
25a
14a
22b
14c
14b
17
17
25
3
3
22
23a
23
22a
24
26
15c
25b
27
1
1
22
23a
15a
25a
23
24
14c
15a
15b
25
27
11
16
24
23b
16
15

CROSS-COUNTRY SKI, SKI BOOT, AND BINDING COMBINATION AND BOOT AND BINDING COMPONENTS THEREOF

BACKGROUND OF THE INVENTION

1. Field:

This invention is concerned with ski boots and bindings for cross-country skiing and with the combination of same as installed on cross-country skis.

2. State of the Art:

Cross-country skiing has become a sport in itself apart from so-called "downhill" skiing, in which expertise at executing slalom-like turns divides experts from intermediate and beginner skiers, and apart from jumping, which is primarily for exhibition.

Regardless of lack of skill, or the extent of skill a person has developed in other aspects of skiing, cross-country skiing has almost universal appeal. It provides exercise in climbing to higher elevations, from where descent can be selected in accordance with desires of the individual, or in touring up and down hills or along the flat for outdoor enjoyment.

Since cross-country skiing is not dependent upon the usual ski lifts and requires considerable manual effort on the part of the skier, special cross-country skis of lightweight and special bindings have been developed. The skis are much narrower than the usual downhill skis, and the bindings provide minimum, if any, capability for release when the skier falls. Also, ordinary hiking boots are normally worn, rather than the very stiff and confining downhill ski boots.

Typical of bindings specially provided for cross-country skiing are those shown in Hilding, Kreyenbuhl, and Weigi U.S. Pat. Nos. 3,003,777; 4,108,467; and 4,266,805, respectively. All of these provide for attachment of the toe of a ski boot forwardly of the sole on an axis extending transversely of the ski. Weigl provides for pivotal movement, about such axis, of a part of the binding constituting a forward extension of the sole of the ski boot, so the length of the ski boot may be pivotally raised and lowered about the axis serving as a transverse line of pivot.

In accordance with the present invention, the sole of the ski boot terminates short of the tip of the toe of the ski boot upper, and a pivot axis, constituting a transverse line of pivot for the toe of the ski boot, is provided immediately behind such tip of the toe. This provides stability for the skier in advancing the ski forwardly during walking and climbing.

Although Beyl U.S. Pat. No. 4,245,409 provides a ski boot having a sole of a predetermined standard length, despite boot size, with toe and heel overhanging the respective ends of the sole, there is no pivoting of the boot relative to the ski. This shortening of the sole relative to the upper is provided merely as a matter of convenience in enabling any size boot to fit a predetermined setting of the toe and heel boot-securement pieces of the ski binding.

SUMMARY OF THE INVENTION

Principal objectives in the making of the present invention were to provide running ease and stability for cross-country skiers, boot comfort, convenience in attaching and detaching the skis relative to the boots, ease in jumping during downhill runs, and help to the skier in climbing over icy areas with skis removed.

Besides the aforementioned placement of a transverse line of pivot immediately back of the tip of the toe of the ski boot upper for the sake of stability and ease of movement, the present invention provides a toe-fitting portion of the ski binding as a permanent part of the ski boot at the toe of the boot in a receiving recess provided below the toe and extending backwardly therefrom along the bottom of the sole, with a transverse bore for receiving a pivot pin in attaching the boot to laterally-placed cheek members that rise from opposite sides of a toe plate attached to the ski. The pivot pin is preferably of partial U formation, having a forwardly placed, latching leg preferably shorter than the other, pivot pin leg and adapted to snap into a receiving latch member at the front of the toe piece by which such pivot pin is held in place during skiing.

The sole of the ski boot is narrower than usual, with practically no overlap laterally of the usual narrow cross-country skis. Projecting forwardly from and along such toe-fitting of the boot, there is preferably provided ice-penetrating means for kicking by the skier into ice when climbing over icy terrain with skis removed. Also, since it is desirable that the forward tips of the skis not lift during flight in the making of jumps on downhill runs, retention spring means is preferably fastened to the ski through the forward portion of the toe plate so as to bear against the toe-fitting of the boot without unduly interfering with normal pivotal movement of the boot in walking and climbing.

In accordance with the invention, superior lateral rigidity is achieved, which results in more efficient transmission to the skis of leg movement by the skier in the exercising of control of the skis.

THE DRAWINGS

In the drawings, which illustrate an embodiment of cross-country ski binding and boot constituting the best mode presently contemplated for carrying out the invention in actual practice:

FIG. 1 represents a view in side elevation, partly in longitudinal section taken on the line 1—1 of FIG. 2, of a cross-country ski boot and binding of the invention fastened to a typical narrow, cross-country ski;

FIG. 2, a fragmentary view in top plan, and partial, axial, horizontal section, of the toe portion of the attached ski binding and toe fitting of the boot, the remainder of the boot not being shown;

FIG. 3, a vertical section taken on the line 3—3 of FIG. 2 showing the combination ski binding and ski of FIGS. 1 and 2 largely in front elevation as an orthographic projection of FIG. 2; and FIG. 4, an exploded view showing in perspective and partial vertical section the several parts of the toe portion of the combination ski binding, ski, and ski boot of the foregoing figures as positionally related to one another.

DETAILED DESCRIPTION OF THE ILLUSTRATED EMBODIMENT

Figures 1, 2, 3:
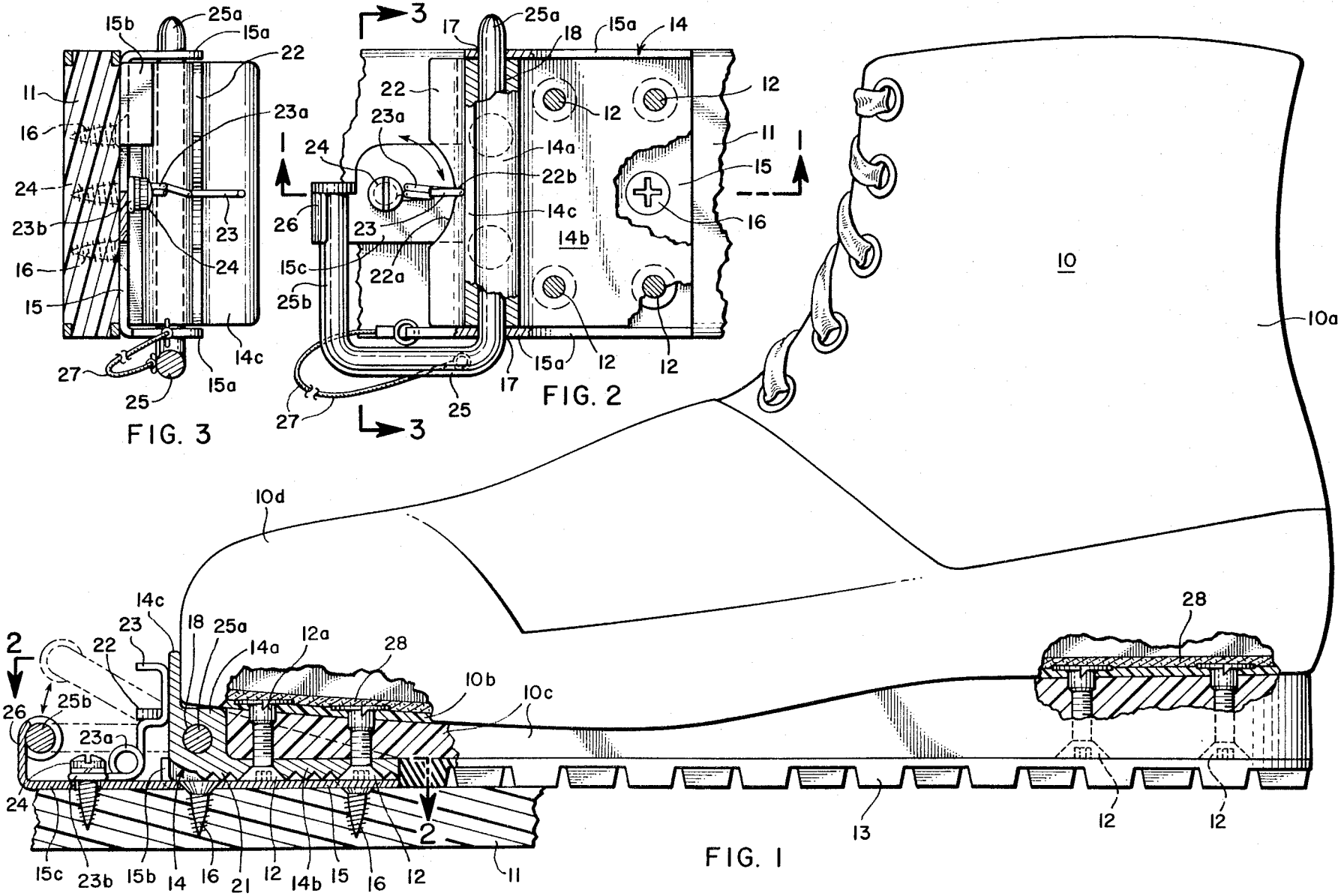

In the particular form illustrated as the best mode presently contemplated of carrying out the invention, a special ski boot 10 is illustrated in FIG. 1 as secured in running position on a usual, narrow, cross-country ski 11 by means of the ski binding of the invention.

The ski boot 10 is a specially modified version of one of a number of possible, commercially available makes of hockey boot, e.g. Lange, Inc.'s Model Laser No. 5, Mississanga, Ontario, Canada; Micron Sport Products, Inc.'s Micron M1 Montreal, Canada; Bauer's Proform Hockey Boot, Kitchener, Ontario, Canada.

The boot upper 10*a* is relatively soft for wearing comfort as compared with the usual heavy and very rigid, downhill ski boot and includes a thin sole 10*b* to which an ice-hockey skate is normally secured. In the present instance, a special relatively thick sole 10*c* replaces the usual ice-hockey skate, being advantageously removably and replaceably attached at toe and heel to thin sole 10*b* by standard screw bolts 12, which have cap nuts 12*a* with overhanging flanges that provide very effective securement. The bottom of thick sole 10*c* is preferably formed with cleats by a cleat plate 13, either molded integrally therewith, or, as shown, molded separately and firmly attached by a suitable adhesive. If and when thick sole 10*c* is to be removed and replaced, access to the rear screw bolts 12 for unscrewing purposes is had through registering openings (not shown) provided in the heel portion of cleat plate 13.

The ski binding of the invention receives a toe-fitting 14, which is securely attached to ski boot 10 at and beneath the toe 10*d* thereof as a normally non-detachable part of such ski boot. The ski binding comprises a toe plate 15 adapted to be secured to the top surface of a ski, here to ski 11 by means of screws 16. Toe plate 15 has cheek plates 15*a*, FIGS. 2 and 3, upstanding therefrom at respectively opposite lateral sides thereof and provided with registering holes 17 for the reception of a pivot pin.

Toe-fitting 14 is desirably formed with a forward transverse portion 14*a*, having a pivot-pin-receiving bore 18 extending therethrough, and with a rearwardly-extending, sole plate portion 14*b* by which such toe-fitting is secured to and beneath toe 10*d* of the boot. To properly accommodate such toe-fitting in accordance with the invention, the thick sole 10*c* of boot 10 is recessed rearwardly, immediately back of the forward tip of boot toe 10*d*, so that the transverse pivot axis, i.e. line of pivot, provided by holes 17 in cheek plates 15*a* and by bore 18 through portion 14*a* of toe-fitting 14, will be located immediately behind and beneath such tip of the toe 10*d* of boot upper 10*a*.

Figure 4:
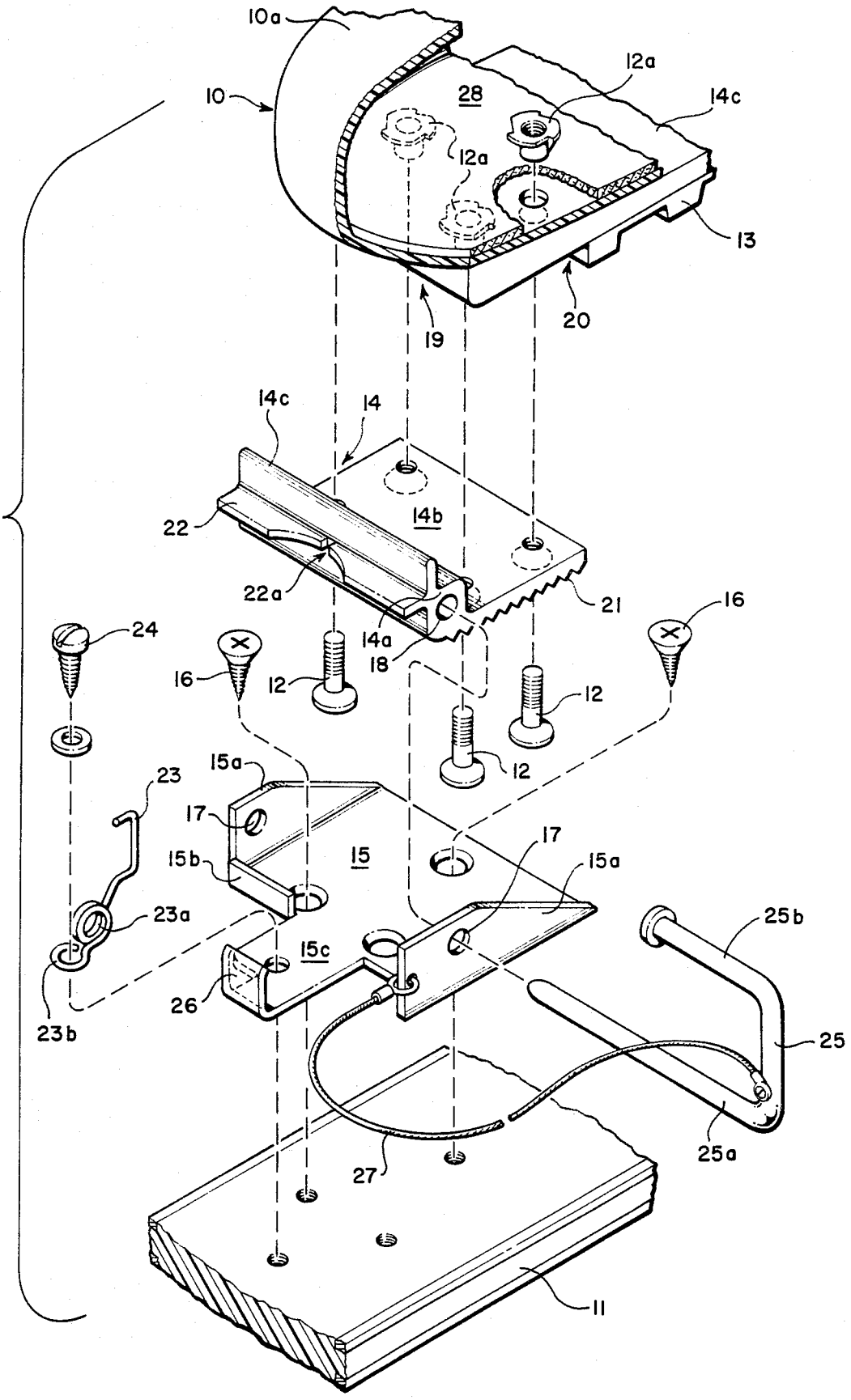

In the illustrated embodiment, thick sole 10*c* terminates, preferably completely, back of the forward tip of boot toe 10*d* by a distance providing a recess, as at 19, FIG. 4, which accommodates portion 14*a* of the toe-fitting, and is further recessed rearwardly, as at 20, to accommodate sole plate portion 14*b* of such toe-fitting. With the depth of such rearward recessing and the thickness of toe plate 15 being together equal to the thickness of cleat plate 13, the entire bottom of the boot can lie in the same plane when resting on top of the ski, as shown in FIG. 1. This is desirable. It is also desirable that the bottom of sole plate portion 14*b* of the toe-fitting be transversely serrated to provide ribs 21, as illustrated, for ease in walking over icy terrain when carrying the skis.

An upstanding transverse member 14*c* is advantageously provided on toe-fitting 14 to protect the toe of the ski boot, and an upstanding limit stop member 15*b* is provided on toe plate 15 as an abutment for the forward face of transverse portion 14*a* of toe-fitting 14 of the boot to quickly and easily insure registration of bore 18 with cheek plate holes 17 in attaching ski boot to ski.

To facilitate climbing over icy terrain when carrying the skis, it is desirable that means, such as a transverse blade member 22, project forwardly from toe-fitting 14 at about the level of the top of thick boot sole 10*c* for kicking by the skier into an icy hillside, and, whether or not this is provided, it is desirable that means be provided for substantially preventing pivotal movement of boot and ski relative to each other when in the air during a jump. This latter means preferably takes the form of a resilient finger 23 upstanding from a coiled portion 23*a* and fastened to the top of the ski, centrally of its width, by a screw 24 passing through an eyelet portion 23*b*. As illustrated, blade member 22 is preferably indented centrally of its width, as at 22*a*, FIGS. 2 and 4, with a finger-accommodating notch 22*b* so that finger 23 will bear against member 14*c* and will be held in place by the notch. When travelling on the level, climbing, or running downhill with no jumps contemplated, the finger assembly may be turned to the side in an out-of-the-way position, as indicated in FIG. 2 by the curved arrow, using screw 24 as a pivot axis.

In its illustrated form, toe-fitting 14 can be economically fabricated from aluminum or other suitable material by extrusion through a suitable die, as is well known in the metal-working art.

Fastening of ski boot to ski, once the ski boot is properly in place on the ski with bore 18 in registry with cheek plate holes 17, is accomplished by inserting a pivot pin in the registering bore and cheek plate openings. The pivot pin is held in its inserted position by suitable latch means.

In this illustrated embodiment, pivot pin 25 is of a general U shape, having a long leg 25*a* and a headed, shorter leg 25*b*, the latter being adapted to snap into an upstanding, resilient latch clip 26, advantageously provided by the forward end 15*c*, FIG. 4, of toe plate 15, and the former adapted to be inserted through cheek plate openings and the bore of toe-fitting 14.

So that pivot pin 25 will not be lost when the skier removes the skis, it is desirably tethered to toe plate 15 as by means of a cable 27.

For foot comfort, boot 10 is desirably provided with an inner sole 28 which covers the flanged nuts 12*a* of screw bolts 12.

The present invention comprehends the total combination of cross-country ski boots as described, cross-country ski binding as described, and cross-country skis, all as worn by a skier, as well as the ski boots alone as a product of manufacture, and the ski binding alone also as a product of manufacture.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. In combination, a caross-country type of ski boot, and a cross-country ski binding for attachment to the ski boot and to a typically narrow, cross-country type of ski, the ski boot having a boot upper and a special thick sole approximating in width the width of the ski and recessed at the tip of the toe of the upper by a distance sufficient to provide a forward, transverse, under-toe recess for accommodating the forward portion of a toe-fitting as a part of the ski binding, which toe fitting is formed with a transverse, pivot-pin-receiving bore and is adapted to be received by the ski binding, and said sole having such a toe-fitting secured thereto, with its forward, pivot-pin-receiving portion received by said under-toe recess so that the pivot-pin-receiving bore is within said recess under said toe of the upper and rearwardly of the tip thereof; the ski binding also having, as a separate part thereof, a toe plate for attachment to the ski, with cheek plates rising therefrom at mutually opposite sides thereof and with registering holes in said cheek plates, respectively, for receiving an elongate pivot pin, the said forward portion of said toe fitting being adapted to be received between said cheek plates of said toe plate, with its said bore in registry with said holes in the cheek plates; an elongate pivot pin adapted to be fitted into said holes of the cheek plates and into said pivot-pin-receiving bore of the boot toe-fitting, thereby securely attaching the boot to the ski; means for latching said pivot pin in place in said cheek plate holes and said bore of the toe-fitting; resilient means adapted for attachment to the ski forwardly of said toe fitting and for selective adjustment into or out of abutting relationship with said toe fitting for substantially preventing pivotal movement of boot and ski relative to each other when in the air during a jump.

2. A combination according to claim 1, wherein the pivot pin is of partial U shape, having one of its legs shorter than the other and adapted for snapping into a resilient latch clip; and such a clip formed at the forward end of the toe plate and having the short leg of the pivot pin snapped thereinto.

3. A combination according to claim 1, wherein the pivotal-movement-preventing means comprises a resilient finger fastened to the ski and normally bearing against the toe-fitting of the ski boot.

4. A combination according to claim 1, wherein a substantially horizontal, substantially centrally recessed, blade member is secured to and projects forwardly from the toe-fitting at about the level of the top of the boot sole, for kicking into icy terrain by the skier when carrying the skis, the resilient finger being positioned intermediate the width of the ski and normally bearing against the toe-fitting of the ski boot within the recess of said blade member.

5. A combination according to claim 1, wherein the toe-fitting of the ski boot is an extrusion.

6. A combination according to claim 1, wherein the toe-fitting of the ski boot has a rearwardly-extending, sole plate portion that is recessed into the forward portion of the sole.

7. A combination according to claim 1, wherein the boot upper is fabricated with a relatively thin sole, and wherein the special thick sole is removably and replaceably fastened to said thin sole.

8. A combination according to claim 7, wherein the special thick sole is fastened to the relatively thin sole of the upper by means of easily removed and replaced screw bolts.

9. A cross-country ski binding, having a toe plate adapted to be secured to the upper surface of a cross-country ski with upstanding cheek plates at respectively opposite sides thereof for receiving a forward, transverse portion of a toe-fitting of a cross-country ski boot, said cheek plates being provided with mutually registering holes therein for registry with a transverse bore in the forward, transverse portion of the toe-fitting, and said ski binding having a pivot pin adapted to fit within the said registering holes of the cheek plates and the bore of the forward portion of the toe-fitting when such forward portion of the toe-fitting is received, said ski binding being characterized by the provision of resilient means adapted to be fastened to the ski forwardly of the toe-fitting of the boot and for selective adjustment into or out of abutting relationship with said toe fitting for substantially preventing pivotal movement of boot and ski relative to each other when in the air during a jump.

10. A cross-country ski binding according to claim 9, wherein the toe fitting has an upstanding transverse portion at and extending across the forward end of a boot sole plate and adapted to receive the pivot pin, and wherein a transverse blade member projects forwardly from the upstanding, transverse portion at about the level of the top thereof for kicking into icy terrain by the skier wearing the boots when walking.

11. A cross-country ski binding according to claim 9, wherein the resilient means comprises spring means for fastening to the skis; and wherein the transverse blade member is indented substantially centrally thereof to accommodate said spring means when adjusted to prevent pivotal movement of boot and ski relative to each other when in the air during a jump.

12. A cross-country ski binding according to claim 9, having a transverse member upstanding from said upstanding, transverse portion to fit against the tip of the toe of the ski boot upper as a protection for said toe of the boot upper.

13. A cross-country ski binding according to claim 12, wherein the toe fitting is fabricated integrally as an extrusion.

14. A cross-country ski binding according to claim 9, wherein the pivotal-movement-preventing means comprises a resilient finger adopted for fastening to the ski so as to normally bear against the toe-fitting of the boot.

15. A cross-country ski binding according to claim 9, further characterized by the provision of a forward portion of the toe plate formed as a resilient latch member and the pivot pin formed of substantially U shape so that one leg of the U fits into the registered holes and bore as a pivot pin and the other leg snaps into latching relationship with said resilient latch member.

16. A cross-country ski binding according to claim 9, further characterized by the fact that the pivot pin is normally free of the holes in the cheek plates; and means are provided tethering said pivot pin to the toe plate.

17. A cross-country ski binding according to claim 10, wherein the bottom face of the sole plate is provided with ice-penetrating projections to aid walking by a skier wearing the boots.

* * * * *